US007967144B2

(12) United States Patent
Sack et al.

(10) Patent No.: US 7,967,144 B2
(45) Date of Patent: Jun. 28, 2011

(54) CHILD-RESISTANT, SENIOR-FRIENDLY PACKAGE HAVING A SQUEEZE-RELEASE MECHANISM AND METHOD OF ASSEMBLY

(75) Inventors: Ryen Sack, Loves Park, IL (US); Curtis A. Knutson, Loves Park, IL (US); Thomas Moyer, Freeport, IL (US)

(73) Assignee: Anderson Packaging, Inc., Rockford, IL (US)

( * ) Notice: Subject to any disclaimer, the term of this patent is extended or adjusted under 35 U.S.C. 154(b) by 0 days.

(21) Appl. No.: 12/614,682

(22) Filed: Nov. 9, 2009

(65) Prior Publication Data

US 2011/0108451 A1 May 12, 2011

(51) Int. Cl.
*B65D 83/04* (2006.01)

(52) U.S. Cl. ..... 206/538

(58) Field of Classification Search ..... 206/528, 206/531, 532, 534.1, 534.2, 536, 538
See application file for complete search history.

(56) References Cited

U.S. PATENT DOCUMENTS

| | | | | | |
|---|---|---|---|---|---|
| 3,888,350 | A * | 6/1975 | Horvath | 206/531 |
| 3,987,891 | A | 10/1976 | Horvath | |
| 4,120,400 | A * | 10/1978 | Kotyuk | 206/528 |
| 4,192,422 | A * | 3/1980 | Kotyuk | 206/528 |
| 4,364,488 | A | 12/1982 | Anjou | |
| 4,401,210 | A | 8/1983 | Anjou | |
| 5,150,793 | A * | 9/1992 | Tannenbaum | 206/531 |
| 5,275,291 | A * | 1/1994 | Sledge | 206/531 |
| 5,740,938 | A | 4/1998 | Hofmann et al. | |
| 5,878,887 | A * | 3/1999 | Parker et al. | 206/528 |
| 6,021,901 | A | 2/2000 | Wolfe | |
| 6,036,018 | A * | 3/2000 | Harrold | 206/536 |
| 6,338,408 | B1 * | 1/2002 | Anderson | 206/538 |
| 6,401,926 | B1 * | 6/2002 | Lo | 206/531 |
| 6,460,693 | B1 | 10/2002 | Harrold | |
| 6,523,691 | B2 * | 2/2003 | Raj et al. | 206/538 |
| 6,641,031 | B2 * | 11/2003 | Evans et al. | 229/102 |
| 6,789,677 | B2 | 9/2004 | Maietta | |
| 6,832,686 | B2 | 12/2004 | Donegan | |
| 6,874,636 | B2 * | 4/2005 | Paliotta et al. | 206/531 |
| 6,976,576 | B2 * | 12/2005 | Intini | 206/1.5 |
| 7,090,079 | B2 * | 8/2006 | Ehrlund | 206/531 |
| 7,581,642 | B2 | 9/2009 | Knutson et al. | |
| 7,617,935 | B2 * | 11/2009 | Reilley et al. | 206/530 |
| 2001/0017273 | A1 * | 8/2001 | Raj et al. | 206/531 |

(Continued)

*Primary Examiner* — Jacob K Ackun, Jr.
(74) *Attorney, Agent, or Firm* — Howson & Howson LLP

(57) ABSTRACT

A package is provided that is able to contain tablets or like separate dispensable items in a manner exhibiting child-resistant and senior-friendly dispensing properties. The package includes a card, such as a blister card, and a protective hollow sleeve. The card has a base strip on which a plurality of spaced-apart compartments are provided for holding the tablets or like items, and the sleeve has an opposed pair of side edges extending between opposite ends with at least one of the ends being a dispensing end of the package. The sleeve provides a protective housing for the card when the card is in a storage position within the sleeve, and the card is slidable relative to the sleeve between the storage position and a dispensing position in which the card extends at least partially outside the sleeve to expose at least one of the compartments. The card has a pair of locking tabs extending laterally from opposite sides of the card, and the side edges of the sleeve cooperatively engage the locking tabs to lock the card in the storage position when the card is slid within the sleeve to the storage position.

16 Claims, 11 Drawing Sheets

U.S. PATENT DOCUMENTS

2004/0045858 A1* 3/2004 Harrold ..... 206/470
2004/0050748 A1* 3/2004 Ehrlund ..... 206/538
2005/0183981 A1* 8/2005 Gelardi ..... 206/531
2007/0102318 A1 5/2007 Gelardi et al.
2007/0181458 A1* 8/2007 Ehrlund ..... 206/528
2007/0272586 A1* 11/2007 Hession ..... 206/532
2008/0251410 A1 10/2008 Gelardi
2008/0290109 A1 11/2008 Williams
2009/0045078 A1* 2/2009 Gelardi et al. ..... 206/1.5
2009/0045096 A1 2/2009 Knutson et al.
2009/0071864 A1 3/2009 Costa et al.
2009/0095649 A1 4/2009 Costa
2009/0178948 A1 7/2009 Reilley et al.
2009/0301924 A1* 12/2009 Rondeau ..... 206/531
2010/0038278 A1* 2/2010 Gattefosse et al. ..... 206/531
2010/0084308 A1* 4/2010 Rigby ..... 206/531

* cited by examiner

CHILD-RESISTANT, SENIOR-FRIENDLY PACKAGE HAVING A SQUEEZE-RELEASE MECHANISM AND METHOD OF ASSEMBLY

BACKGROUND OF THE INVENTION

The present invention relates to a package for containing separate items, such as pills, tablets, doses of medicine, or the like, that can be stored therein and dispensed therefrom by an intended end-user, and more particularly, the present invention relates to a package including an outer sleeve housing a blister card that is slidable into and out of the sleeve whereby the structures of the sleeve and blister card interact to provide child-resistant, senior-friendly dispensing properties.

U.S. Pat. No. 7,581,642 B2 issued to Knutson et al. and U.S. Patent Application Publication Nos. 2009/0045096 A1 of Knutson et al. and 2009/0178948 A1 of Reilley et al. are assigned to Anderson Packaging, Inc., the assignee of the present application, and disclose examples of packages including a molded plastic sleeve and blister card combination that provides child-resistant, senior-friendly dispensing properties. Other examples of packages are disclosed, for instance, by U.S. Patent Application Publication Nos. 2007/0102318 A1 and 2005/0183981 A1.

Although the packages disclosed by the above referenced patent and published applications are suitable for their intended purposes, there is a need for alternate designs of such packages that are of novel construction and that are difficult for a young child to open (i.e. receive a so-called "F=1" child resistant rating), yet can readily be opened and closed by an intended end-user, such as a senior citizen. Such a package may include a molded plastic container body or sleeve for storing a blister card, tray or the like on which numerous items, such as tablets, doses of medicine, or the like, are individually secured in blister compartments. Preferably, the blister card should be able to be slid between a retracted position in which the items are protected and housed within the sleeve and a dispensing position in which the blister card at least partially extends in an exposed position from the sleeve. In addition, preferably the package is one that can be made of a minimal amount of plastic, yet be of sufficient strength to produce a functional child-resistant package.

BRIEF SUMMARY OF THE INVENTION

A package is provided that is able to contain tablets or like separate dispensable items in a manner exhibiting child-resistant and senior-friendly storage and dispensing properties. The package includes a card, such as a blister card, and a protective hollow sleeve. The card has a base strip on which a plurality of spaced-apart compartments are provided for holding the tablets or like items, and the sleeve has an opposed pair of side edges extending between opposite ends with at least one of the ends being a dispensing end of the package. The sleeve provides a protective housing for the card when the card is in a storage position within the sleeve, and the card is slidable relative to the sleeve between the storage position and a dispensing position in which the card extends at least partially outside the sleeve to expose at least one of the compartments. The card has a pair of locking tabs extending laterally from opposite sides of the card, and the side edges of the sleeve cooperatively engage the locking tabs to lock the card in the storage position when the card is slid within the sleeve to the storage position.

The side edges of the sleeve can have openings or recesses cooperating and registering with the locking tabs of the card to automatically lock the card in the storage position when the card is slid within the sleeve to the storage position. The locking tabs are resiliently connected to the card such that the locking tabs are resiliently urged into the openings or recesses in the side edges of the sleeve when the locking tabs register with the openings or recesses. In addition, the resilient connection of the locking tabs to the card is flexible such that simultaneous squeezing of the locking tabs toward one another and inward of the sleeve unlocks the card from the sleeve and permits the card to slide relative to the sleeve, such as to a dispensing position.

The card can have a pair of lateral extensions, or wings, on which the locking tabs are located. The lateral extensions connect to the card via live hinges and pivot relative to the card about the live hinges. The base strip of the card can be a sheet of plastic material with the lateral extensions and live hinges being formed as an integral part of the base strip. The hollow sleeve can be a one-piece, molded, elongate, plastic sleeve having opposite wall panels interconnected and spaced-apart by the opposite pair of elongate side edges.

According to another aspect of the present invention, a method of assembling a child-resistant, senior-friendly package for containing tablets or like separate dispensable items is provided. A blister card is formed with blister compartments and a pair of wings extending laterally of the blister card from opposite sides of the blister card, and a locking tab is provided on each wing. The wings are folded or pivoted about resilient hinges interconnecting the wings to the blister card, and the blister card is slid into a protective sleeve while the wings remain folded until the locking tabs on the wings register and cooperatively resiliently snap into openings formed in side edges of the sleeve to lock the blister card in a storage position within the sleeve. The method can also include the step of molding the sleeve of plastic such that the sleeve is a one piece molded hollow body having an open dispensing end and an opposite end.

BRIEF DESCRIPTION OF THE DRAWINGS

The present invention should become apparent from the following description when taken in conjunction with the accompanying drawings, in which.

DETAILED DESCRIPTION OF THE INVENTION

First and second embodiments of the present invention are illustrated in FIGS. 1-12 and FIGS. 13-19, respectively. The first and second embodiments have common features; however, a primary difference between the embodiments is that the first embodiment is specifically directed to a package including only a single blister card; whereas, the second embodiment is directed to a similar package able to include a plurality of separate blister cards. For simplicity and illustrative purposes, the principles of the embodiments are described by referring mainly to examples thereof. In the following description, numerous specific details are set forth in order to provide a thorough understanding of the embodiments. It will be apparent however, to one of ordinary skill in the art, that the embodiments may be practiced without limitation to at least some of the specific details.

Figure 1:
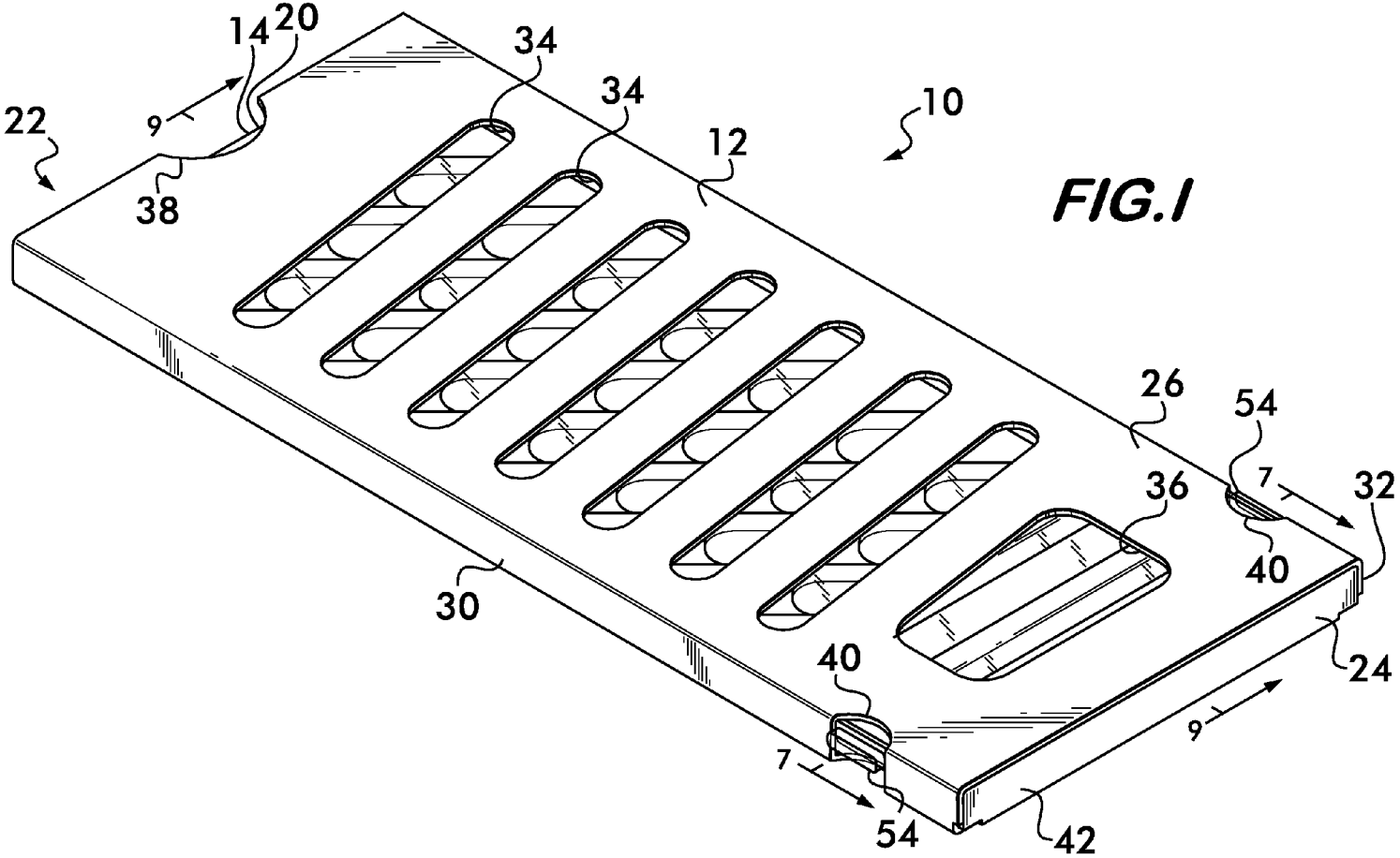
FIG. 1 is perspective view of a package assembly according to the present invention including a blister card locked within a protective sleeve.
Figure 2:
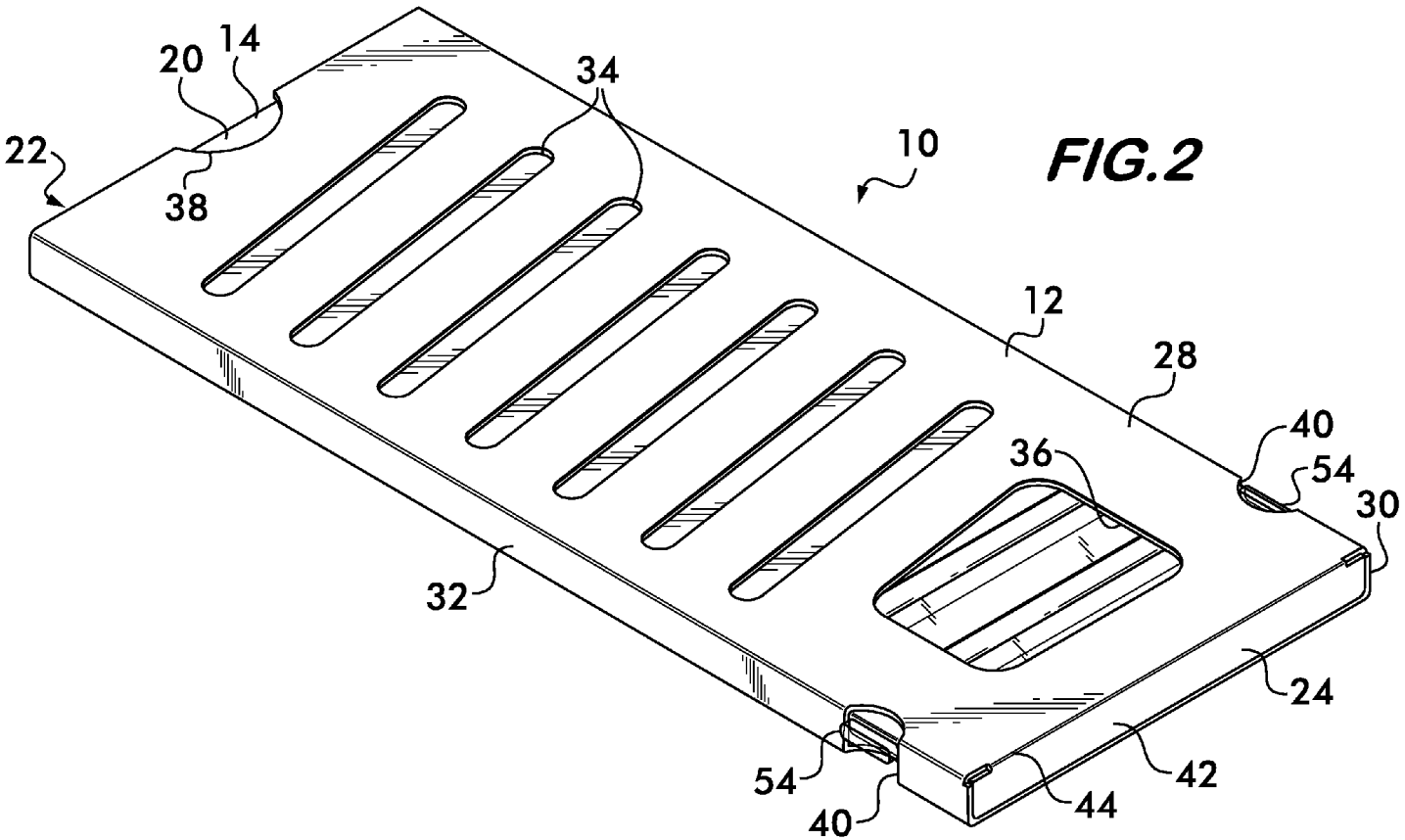
FIG. 2 is perspective view of the underside of the package assembly of FIG. 1.

With respect to the first embodiment, a fully assembled package 10 according to the present invention is illustrated in FIG. 1. The package 10 has a compact box-like shape that can be generally thin and elongate and that can be held in a person's hand. A relatively-rigid outer sleeve 12 of a generally rectangular configuration houses a separately-manufactured blister card 14 or the like that has a set of individual blister compartments 16. Each blister compartment initially contains a pill, tablet and/or like separate small item (not shown) which can be stored within the package 10 and dispensed therefrom.

In FIG. 1, the blister card 14 is shown in a storage position in which the blister card 14 is housed and protected within the sleeve 12. In this condition, the pills, tablets and/or like separate small items within the blister compartments 16 cannot be accessed, dispensed, or otherwise separated from the blister card 14. Accordingly, a young child cannot access the tablets or the like, or the blister compartments 16, when the blister card 14 is retained in the storage position.

For purposes of dispensing a pill, tablet and/or like separate small item from the package 10, the blister card 14 can be slid relative to the outer sleeve 12 through an open end 18 of the sleeve 12 to a dispensing position under certain conditions. A dispensing position of the blister card 14 is shown, for instance, in FIG. 10. In this position, one or more blister compartments 16 can be accessed external of the sleeve 12 for dispensing a pill, tablet and/or like separate small item from the blister card 14. For instance, pressure can be readily exerted downward upon one of the exposed blister compartments 16 to force the tablet or the like to break through a backing layer 18 on the underside of the blister card 14.

A feature of the package 10 of the present invention is that it includes a resilient-locking and squeeze-release mechanism that provides child-resistant properties with respect to sliding the blister card 14 from the storage position to a dispensing position. When the blister card 14 is fully inserted into the outer sleeve 12 (i.e., in the storage position as shown in FIG. 1), the blister card 14 becomes automatically locked and engaged to the sleeve 12 and cannot be removed from the outer sleeve 12 without a user simultaneously accomplishing multiple tasks that would be considered difficult for a young child to accomplish. For example, specific locations of opposite outer edges of the outer sleeve 12 are required to be simultaneously squeezed inward in opposite directions toward each other while at the same time a small exposed leading edge 20 of the blister card 14 is gripped and pulled through the open dispensing end 22 of the outer sleeve 12. Thus, a user must simultaneously perform both the squeezing and pulling actions for the blister card 14 to be freed from the storage position.

These simultaneous actions are considered difficult for a young child to accomplish for the following reasons. The width "W" of the package 10 can be provided such that a young child's hand is not expected to be sufficiently large as to be able to span and grasp about the width "W" which is otherwise required to squeeze the package 10 with a single hand. Also, the simultaneous actions of squeezing the package 10, for instance at one end 24 of the package 10, and pulling the blister card 14 forward at the opposite open end 22 of the package 10 requires a certain level of dexterity also not expected of a young child.

However, it should be noted that an adult, including a senior citizen, should readily be able to operate the package 10. One hand of the adult should be able to readily grip and squeeze the package 10 adjacent the non-dispensing end 24 and the other hand of the adult should be able to grip and pull the exposed leading edge 20 of the blister card 14 at the opposite open dispensing end 22 of the package 10. After the blister card 14 is partially or fully extended from the package 10 in a dispensing position, force can be exerted on one of the blister compartments 16 to break the contained item through a foil or like backing layer 18 on the underside of the blister card 14 that seals the item within the blister compartment 16. Thereafter, the blister card 14 can be pushed to slide back into the sleeve 12 to return the blister card 14 to the storage position. When this occurs, the locking mechanism is automatically actuated and the blister card 14 is once again locked within the outer sleeve 12 as discussed above.

In the first illustrated embodiment of the present invention, the outer sleeve 12 is molded of a material such that it is hollow and made of one-piece. For example, the sleeve 12 can be made of plastic formed into shape by injection molding, blow molding, or like molding technique. A benefit of molding the sleeve as an integral single piece is that the amount of plastic required to make the sleeve can be significantly reduced while maintaining a desired degree of strength and rigidity needed for providing a functional child resistant package. Also, the process of assembling the package is greatly simplified since very little is required relative to preparing the sleeve. The material used to make the sleeve 12 can be a plastic material, a recycled plastic material, a thermoplastic material such as polypropylene, or any other material (metal, composite, paperboard, etc.) that can be formed into a sleeve-shape container that is preferably of one-piece construction.

In the first illustrated embodiment, the sleeve 12 includes a substantially-rectangular, relatively-large upper wall panel 26, a substantially-rectangular, relatively-large lower wall panel 28, an opposed pair of side edges 30 and 32, the open dispensing end 22, and the opposite end 24. The opposite end 24 may be a non-dispensing end and may be provided in a closed condition. As discussed below in greater detail, the end 24 may be used to initially load a blister card 14 into the sleeve 12 before the end 24 is closed. This enables the open dispensing end 22 to be provided with a smaller opening which can be specifically designed to prevent complete separation of the blister card 14 from the sleeve 12 when the blister card 14 is positioned in a full dispensing position and extends from the sleeve 12 via the dispensing end 22.

The upper and lower wall panels 26 and 28 are required to extend over and parallel to the upper and lower faces of the blister card 14; thus, the upper and lower panels 26 and 28 merely need to be of a size that is slightly greater than the size of the blister card 14 or at least the area of the blister card 14 on which the blister compartments 16 are located. The upper and lower wall panels 26 and 28 can be generally solid; however, as illustrated, they can include slot or other shaped openings 34 for aesthetic purposes and/or for purposes of reducing the amount of plastic required to make the sleeve. Although the openings 34 exist in the panels 26 and 28, their pattern, location and size are such that they prevent unwanted access and dispensing of the contained items from the blister compartments 16 and such that they do not greatly reduce the desired strength or rigidity of the package 10. The panels 26 and 28 can also include an optional window-type opening 36 for aesthetic purposes or for providing space for a label (not shown) or the like on the blister card 14 to be readable through one or both panels 26 and 28 of the sleeve 12 when the blister card 14 is in the storage position. Finally, the panels 26 and 28 can include a small cut-out section 38 adjacent the open dispensing end 22 of the sleeve 12 for purposes of exposing the leading edge 20 of the blister card 14 thereby enabling ready gripping of the leading edge 20 when the blister card is to be slid/pulled through the open dispensing end 22 of the package 10.

Figure 9:
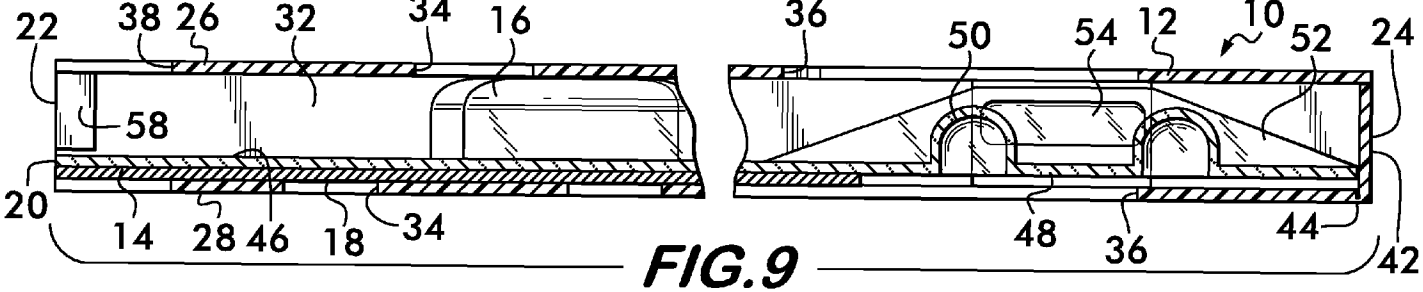
FIG. 9 is a cross-sectional view of the package assembly along line 9-9 of FIG. 1.
Figure 12:
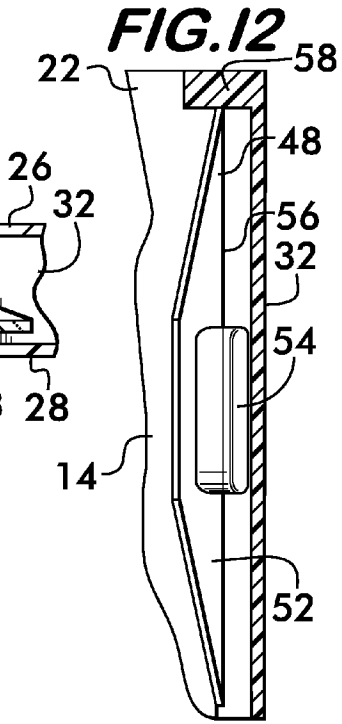
FIG. 12 is a cross-sectional view of the package assembly along line 12-12 of FIG. 11.
Figure 10:
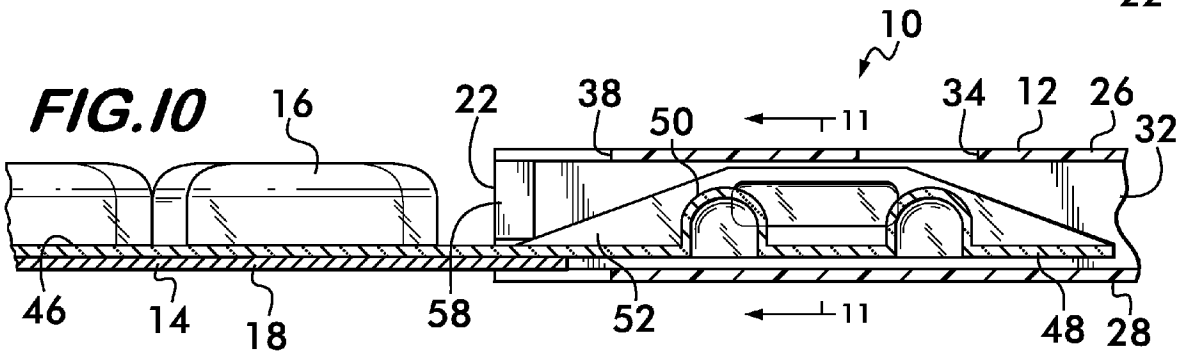
FIG. 10 is a cross-sectional view showing the blister card in a dispensing position adjacent the dispensing end of the protective sleeve.

The side edges 30 and 32 of the sleeve 12 define the thickness "T" of the package 10 and therefore the spacing between the wall panels 26 and 28. This spacing need only be slightly greater than the height of the blister compartments 16 as best shown in FIG. 9. A pair of openings, flexible recesses, or the like 40 are formed in the opposite side edges 30 and 32 of the sleeve 12. These openings form part of the locking mechanism of the package 10 which secures a blister card 14 in the storage position. Preferably, the openings or recesses 40 are located remote from the open dispensing end 22 of the package 10 and adjacent the functionally closed end 24 of the package 10. Alternatively, the openings or recesses 40 can be located anywhere along the side edges 30 and 32. In addition, the openings or recesses 40 can be located directly across from one another as shown in FIG. 1, or they can be offset or staggered from one another along the side edges 30 and 32.

For purposes of maximizing child-resistance of the package, the spacing "W" between the opposite openings 40 in the side edges 30 and 32 of the sleeve 12 can be selected such that the spacing "W" is relatively large in comparison to the size of young child's hand, yet is readily engage-able between the thumb and finger of one hand of an adult. For example, the spacing "W" can be 2 inches, 3 inches, or greater. Of course, the spacing "W" can also be 1 inch or greater.

Figure 3:
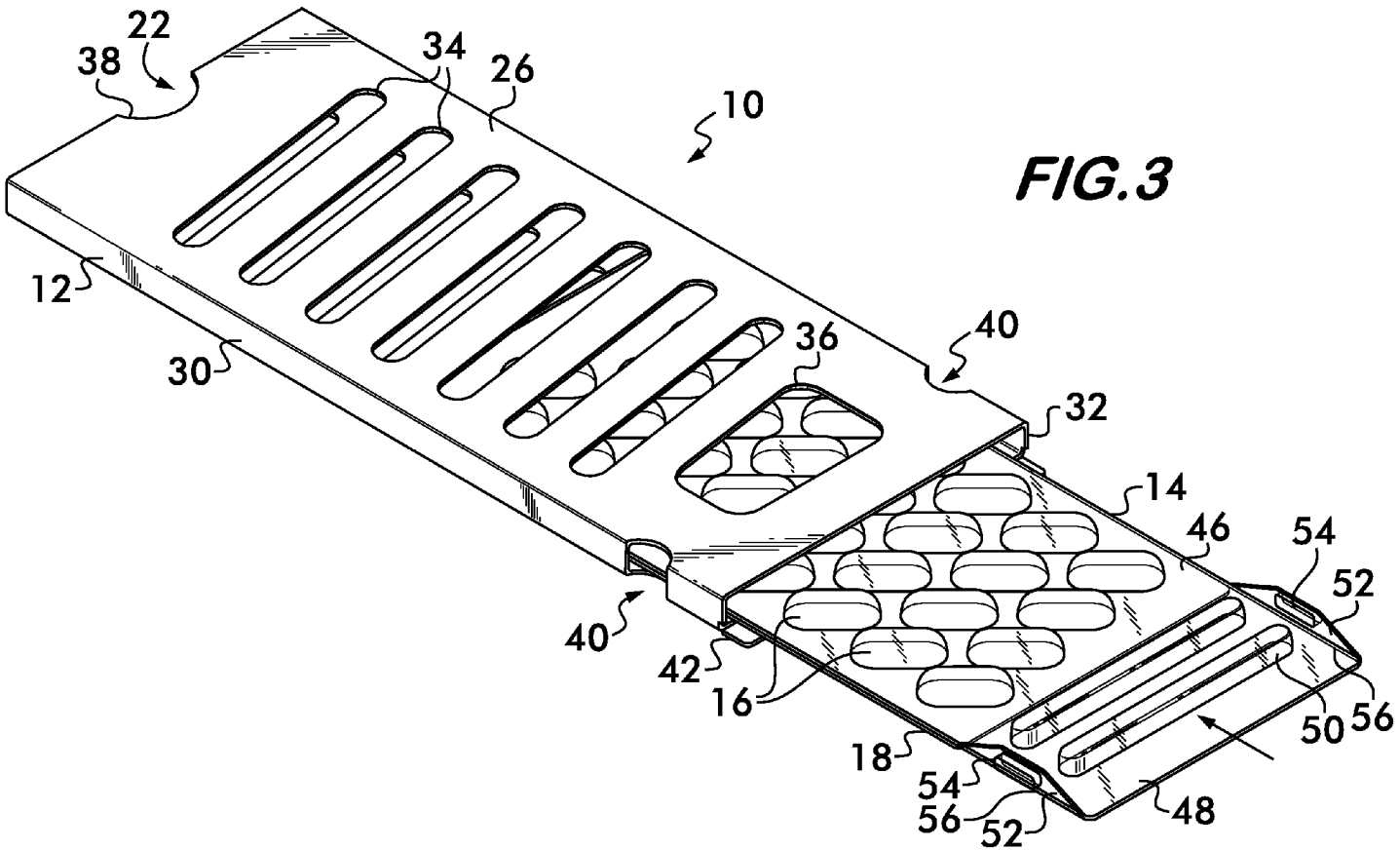
FIG. 3 is a perspective view of the package of FIG. 1 showing the blister card partially inserted into the protective sleeve during an initial loading operation.
Figure 4:
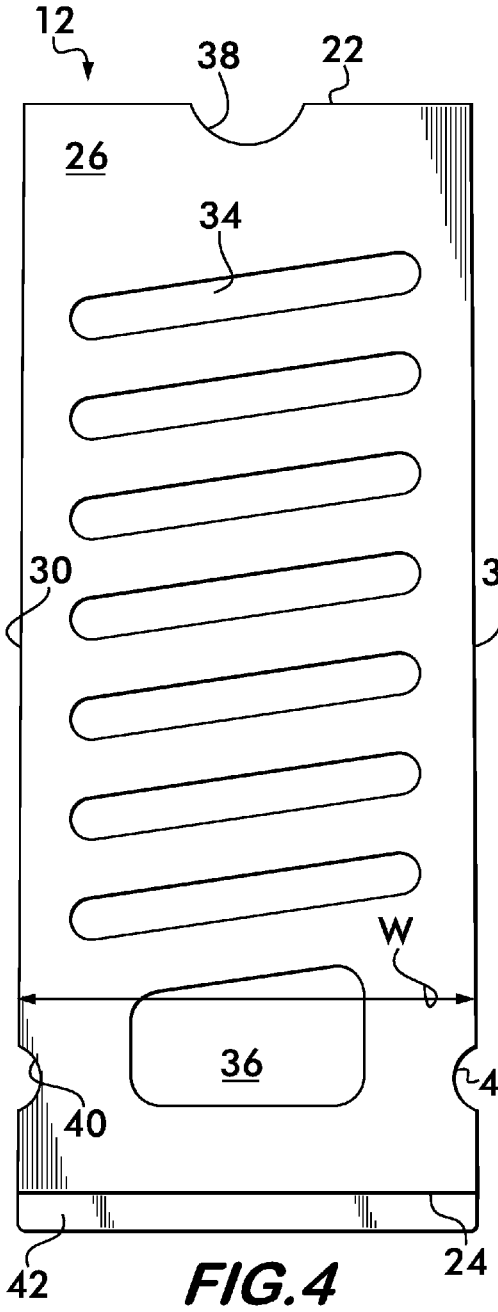
FIGS. 4 and 5 are plan views of opposite panels of the protective sleeve according to the present invention.
Figure 5:
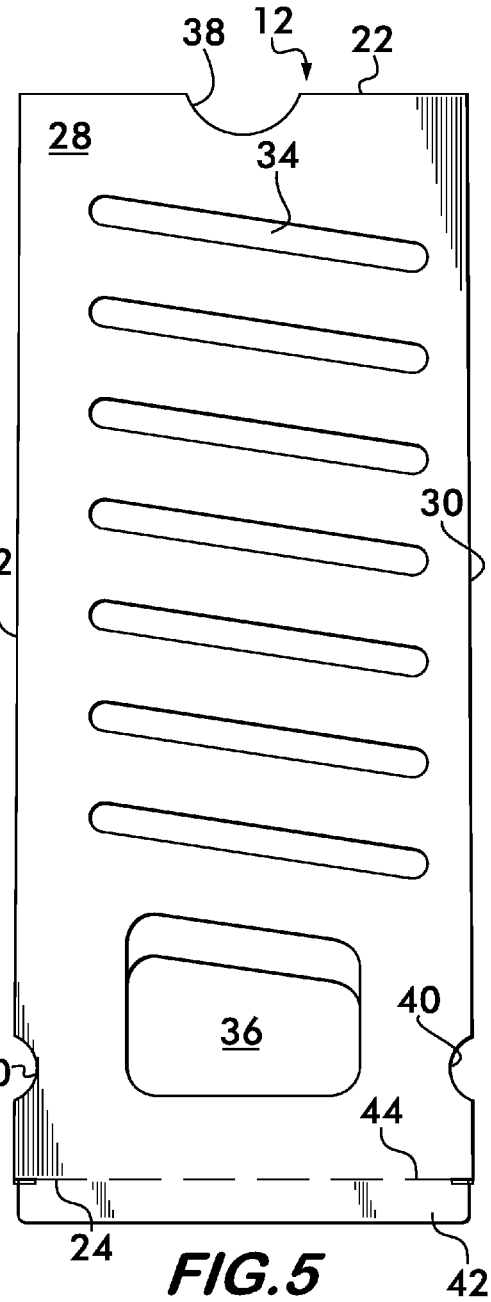

The non-dispensing end 24 of the sleeve 12 can include an end wall 42. For instance, the end wall 42 can be secured in place (snapped, held by friction, bonded, glued, taped, etc.) to close the otherwise open end 24 of the sleeve 12 after the blister card 14 is loaded into the sleeve 12 through, for instance, the non-dispensing end 24. See FIG. 3. As best illustrated in FIGS. 4, 5 and 9, the end wall 42 can be formed integral with one of the wall panels 26 or 28 via a live hinge 44 and can be bent or folded into position to close the end 24 of the sleeve 12. Alternatively, the end wall 42 can be separate of the sleeve 12 and be secured in place on the end 24 of the sleeve 12. Yet another alternative is to utilize tape, a post, a flange or the like to provide a stop adjacent the end 24 of the sleeve 12 merely for the purpose of preventing the blister card 14 from passing through the end 24 of the sleeve 12.

Figure 6:
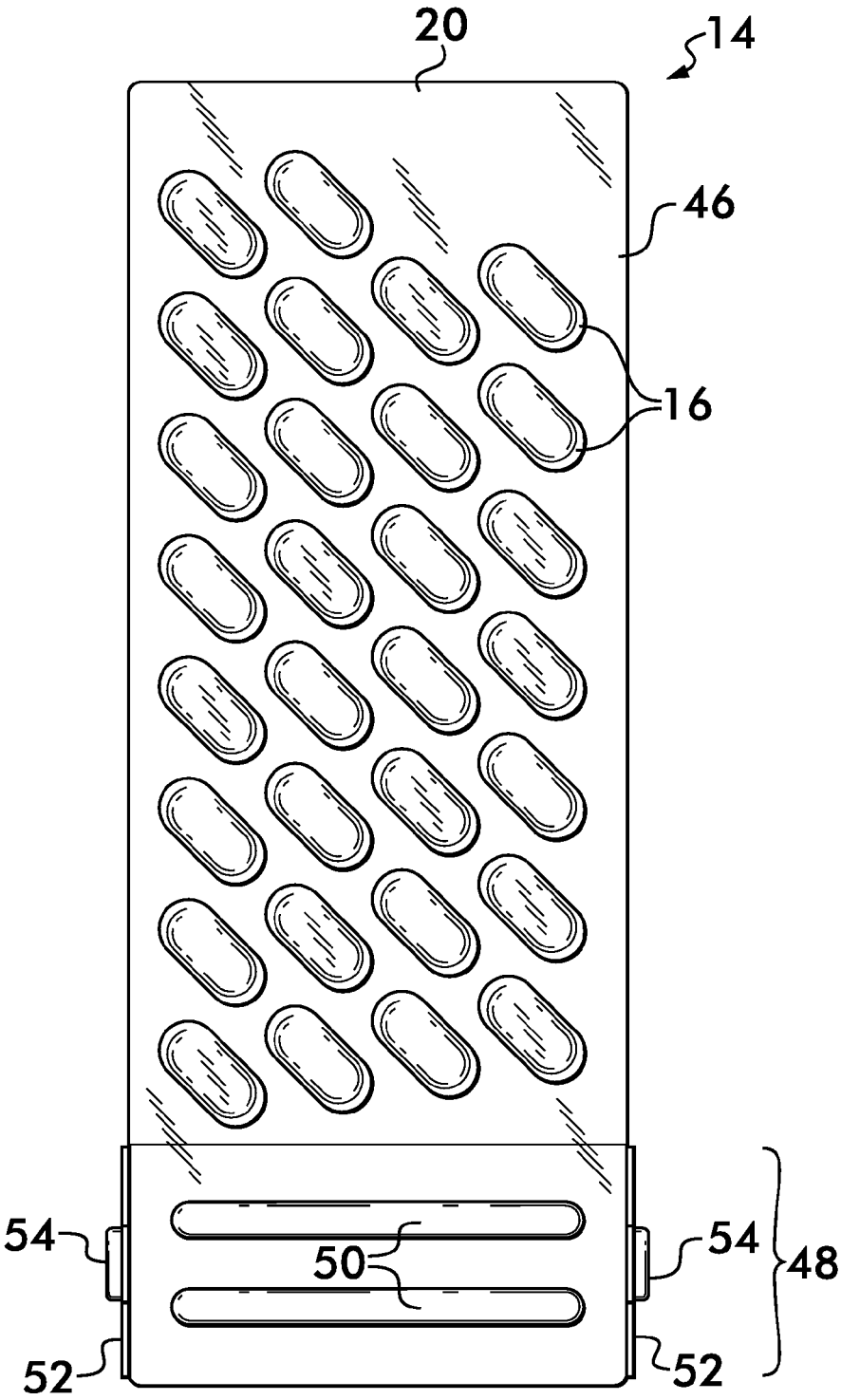
FIG. 6 is a top plan view of a blister card according to the present invention.
Figure 7:
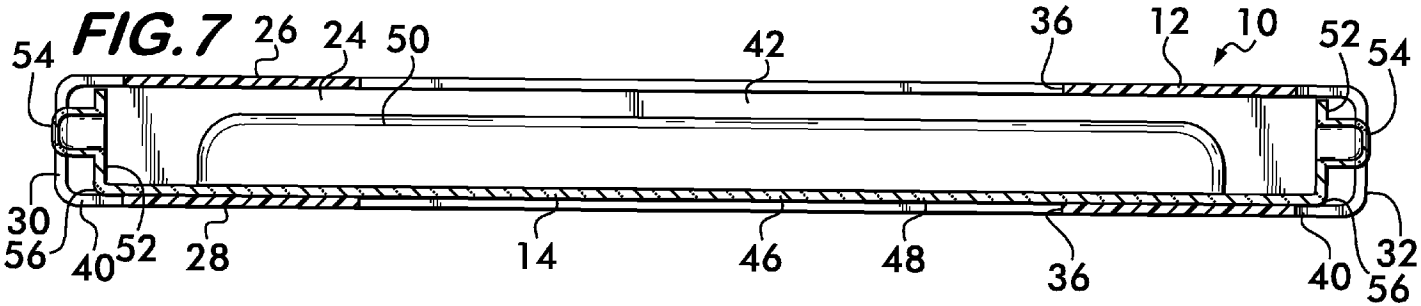
FIG. 7 is a cross-sectional view of the package assembly along line 7-7 of FIG. 1.

Turning to the structure of the blister card 14, it is best illustrated in FIG. 6. The illustrated blister card 14 includes an elongate, generally-planar base strip of material 46 from which a plurality of laterally spaced-apart raised blister compartments 16 project. For example, the strip 46 can be made of thermoformable transparent plastic material and the blister compartments 16 can be provided as depressions/projections molded into a face thereof. Other configurations are also possible. A tablet or like small item can be placed in each hollow open ended compartment 16 and a foil backing or the like 18 can be secured (via adhesion or the like) to a rear face of the strip 46 to seal the tablets or like small items within the blister compartments 16.

In the first illustrated embodiment, the blister card 14 includes a tail end section 48 opposite from its leading edge 20. The tail end section 48 can be formed as an integral continuation of the base strip 46, or alternatively, can be formed separate of the base strip 46 and simply be secured to one end thereof. The purpose of the tail end section 48 is to cooperate with the side edges 30 and 32 of the sleeve 12 to form the locking/release mechanism. The tail end section 48 can also be used to carry a label or other information which is viewable through the window-like opening 36 of the sleeve 12 discussed above. Further, the tail end section 48 can include ribs 50 or other formations for purposes of strengthening or rigidifying the tail end section 48 of the blister card 14.

In the illustrated first embodiment, the tail end section 48, as manufactured, includes a pair of lateral extensions or wings 52 in which tabs or like projections 54 are formed and/or attached. In the illustrated embodiment, the tabs 54 are formed as a thermoformed hollow projection or depression from the base strip material 46 and extend from the base strip material 46 in an opposite direction relative to the blister compartments 16. The tabs 54 function as latches of the locking mechanism of the package 10 and are cooperatively receivable in the openings or recesses 40 in the side edges 30 and 32 of the sleeve 12. Preferably, the wings 52 interconnect to the tail end section via resilient live hinges 56 which permit the wings 52 to be resiliently bent, flexed, folded, or pivoted relative to the remainder of the tail end section 48. This enables the wings 52 to be positioned generally perpendicular to the base strip material 46 to enable initial insertion of the blister card 14 into the sleeve 12. In this position, the tabs or latches 54 extend laterally of the blister card 14 in opposite directions such they can register with and extend within and/or through the openings 40 in the side edges 30 and 32 of the sleeve 12.

The interconnection between the wings 52 and the remainder of the tail end section 48 is such that a resilient force is constantly exerted on the tabs 54 in a direction into engagement with the openings or recesses 40 of the side edges 30 and 32 of the sleeve 12. This force results in the wings 52 attempting to pivot about the live hinges 56 to return to a flattened, as manufactured, condition. Thus, when the tabs 54 register with the openings 40, they resiliently pivot into the openings 40 and become trapped or locked therein. Undesired dislodging of the tabs 54 from the openings 40 is avoided due to this constant resilient force created by the interconnection of the wings 52 to the tail end section 48.

Figure 11:
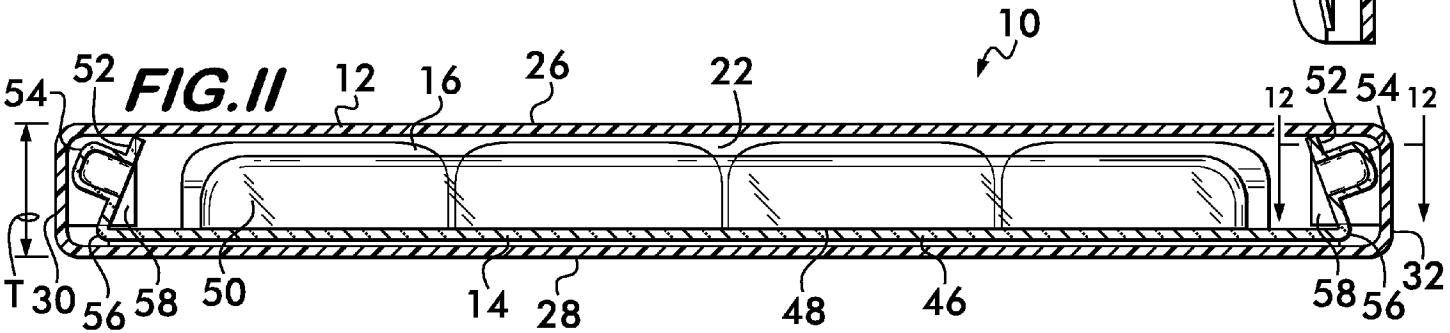
FIG. 11 is a cross-sectional view of the package assembly along line 11-11 of FIG. 10.

Accordingly, the separately-manufactured blister card 14 can be inserted into the sleeve 12 by sliding the leading edge 18 of the blister card 14 into the rear end 24 of the sleeve 12. See FIG. 3. The wings 52 of the tail end section 48 of the blister card 14 shown in FIG. 3 are folded upward to permit the wings 52 to be received within the sleeve 12. As best shown in FIG. 11, the tabs or latches 54 engage the solid side edges 30 and 32 of the sleeve 12 until they register with the openings 40. When this occurs, the tabs 54 resiliently extend into the openings 40 due to the wings 52 resiliently pivoting about the live hinges 56. See FIG. 7. Thereafter, the end wall 42 or the like can be secured in place across the rear end 24 of the sleeve 12 to provide a stop thereby preventing withdraw of the blister card 14 through the rear end.

Figure 8:
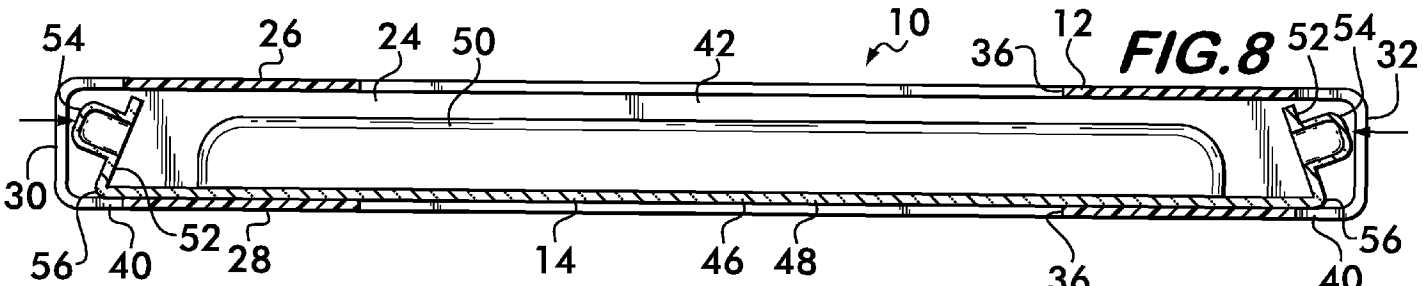
FIG. 8 is a cross-sectional view of the package similar to FIG. 7, except with the locking feature of the package disengaged to permit the blister card to slide relative to the protective sleeve.

When a user desires to dispense a tablet or the like from the package 10, the user squeezes the opposite tabs or latches 54, such as between a thumb and finger of one hand, to simultaneously position the tabs or latches 54 inward as best shown in FIG. 8. In this condition, the user can grip the leading front edge 18 of the blister card 14 adjacent the open dispensing end 22 of the sleeve (see FIG. 1) and pull the blister card 14 through the open dispensing end 22 via a sliding motion. As the blister card 14 is slid through the sleeve 12, the tabs 54 engage and slide along the solid sections of the side edges 30 and 32 as best illustrated in FIG. 11. However, the sleeve 12 includes a pair of stops 58 adjacent the open dispensing end 22 of the sleeve 12 which engage the wings 52 and prevent the tail end section 48 from passing through the open dispensing end 22. For example, see FIGS. 9-12. The stops can be provided as wall sections, flanges or posts that permit the section of the blister card 14 having the blister compartments 16 to readily pass through the open dispensing end 22 of the sleeve 12, yet limit the tail end section 48 from passing therethrough. Accordingly, the blister card 14 is effectively tethered to the sleeve 12 and cannot be completely separated therefrom during the useful life of the package 10.

Figure 13:
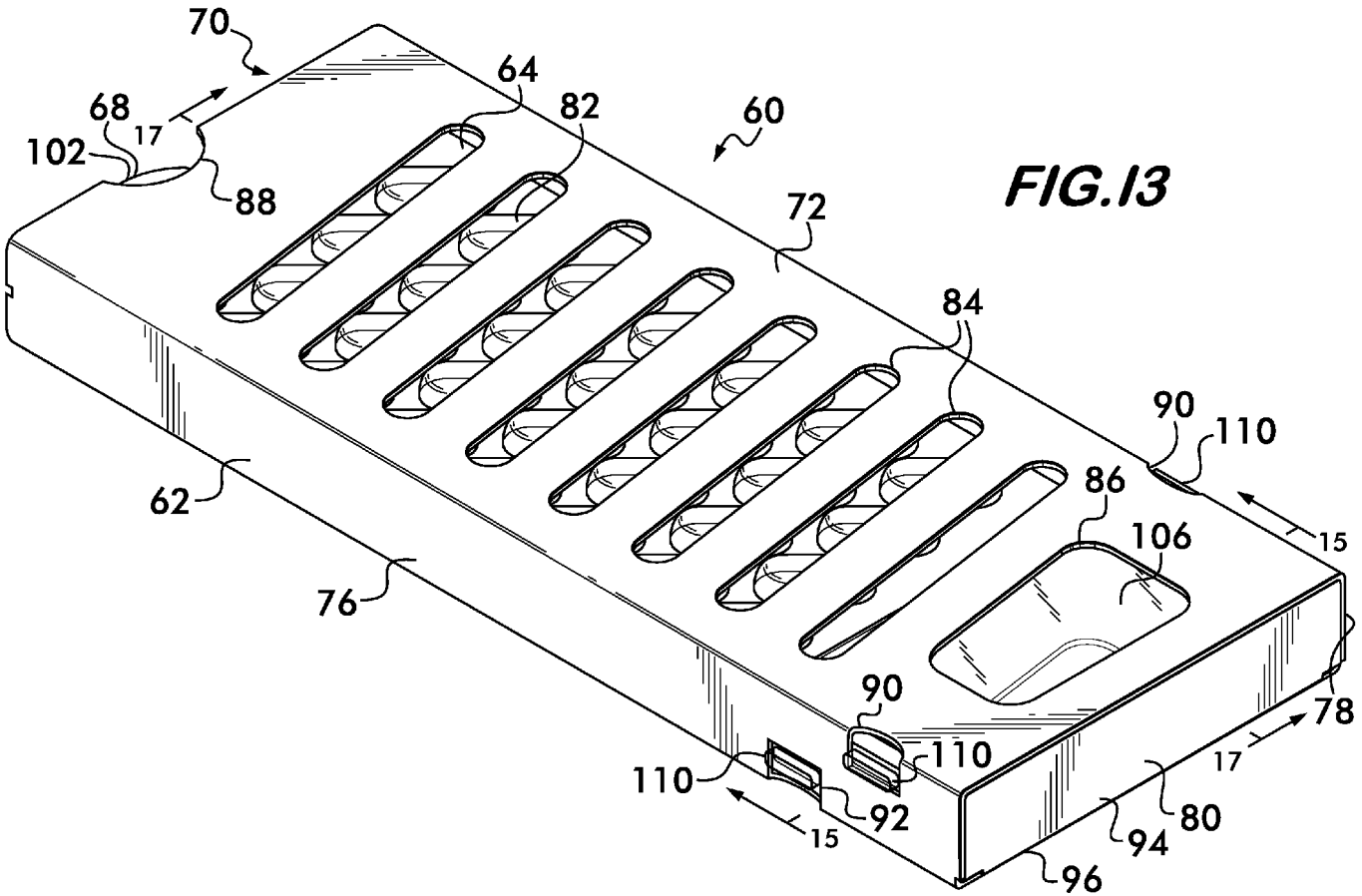
FIG. 13 is perspective view of a second embodiment of a package assembly according to the present invention including a pair of blister cards locked within a single protective sleeve.
Figure 14:
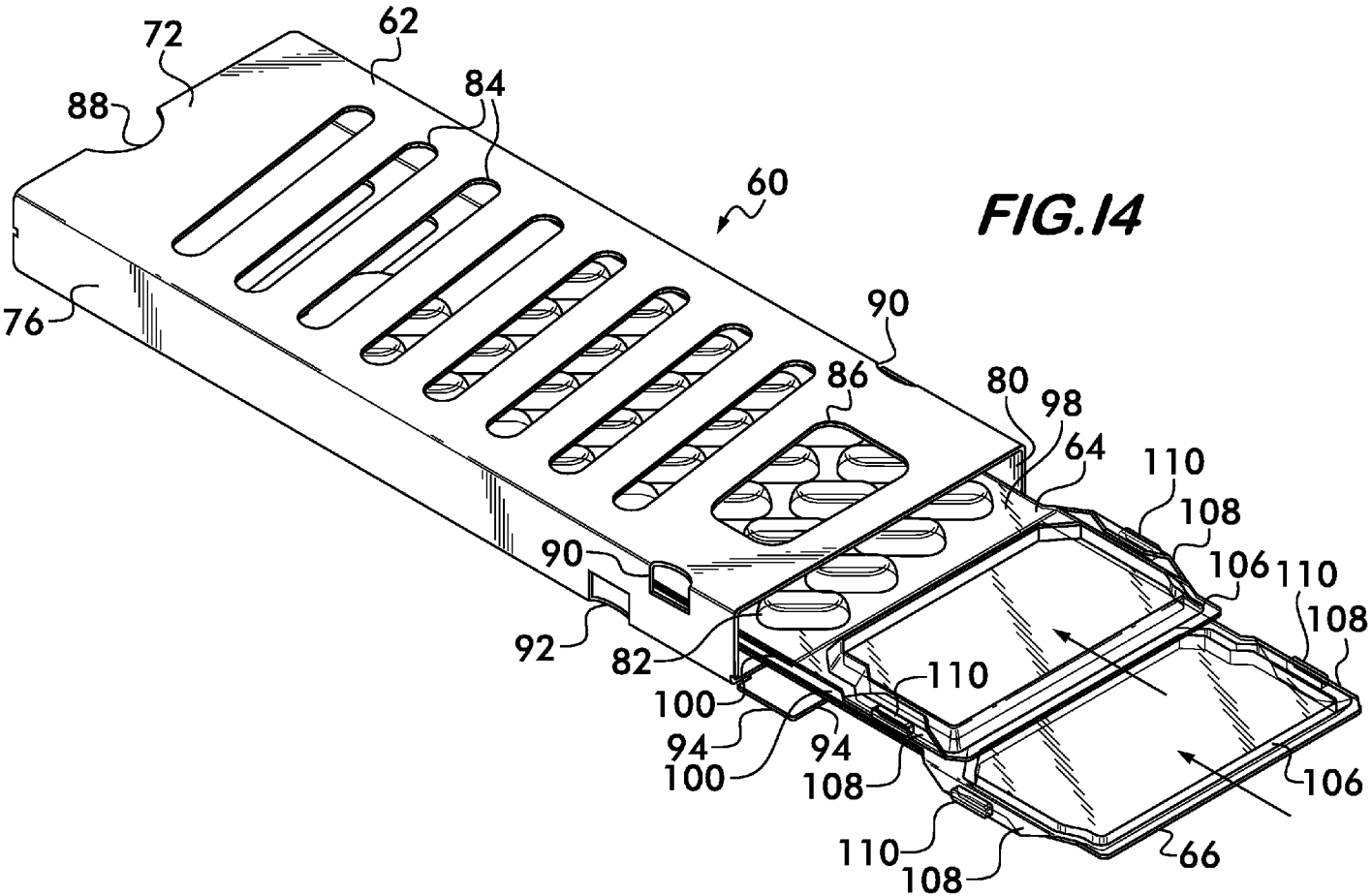
FIG. 14 is a perspective view of the package of FIG. 13 showing the blister cards partially inserted into the protective sleeve during an initial loading operation.

A second contemplated embodiment of the present invention is illustrated in FIGS. 13-19. In this embodiment, a package 60 includes a one-piece molded sleeve 62 for housing a pair of separate blister cards, 64 and 66, back-to-back therein. Similar to the package 10 discussed above, the package 60 includes a resilient-locking and squeeze-release mechanism that provides child-resistant properties with respect to sliding the blister cards, 64 and 66, from a storage position to a dispensing position. When the blister cards, 64 and 66, are fully inserted into the outer sleeve 62 (i.e., in the storage position as shown in FIG. 13), the blister cards 64 and 66, each independently become automatically locked within the sleeve 62 and cannot be withdrawn from the outer sleeve 62 without a user simultaneously accomplishing multiple manipulations of the package 60.

For example, specific locations of opposite outer edges of the outer sleeve 62 are required to be squeezed inward in opposite directions simultaneously while a small exposed leading edge 68 of the respective blister card, 64 or 66, is gripped and pulled through an open dispensing end 70 of the outer sleeve 62. Thus, a user must simultaneously perform both the squeezing and pulling actions with respect to one of the blister cards, 64 or 66, for that particular blister card to be freed to advance it from the storage position.

The outer sleeve 62, as illustrated, is molded of a material such that it is hollow and made of one-piece. For example, the sleeve 62 can be made of plastic formed into shape by injection molding, blow molding, or like technique. A benefit of molding the sleeve as an integral single piece is that the amount of plastic required to make the sleeve can be significantly reduced while maintaining a desired degree of strength and rigidity needed for providing a functional child resistant package. Also, the process of assembling the package is also greatly simplified. The material used to make the sleeve 62 can be a plastic material, a recycled plastic material, a thermoplastic material such as polypropylene, or any other material (metal, composite, paperboard, etc.) than can be formed into a sleeve-shape container that is preferably of one-piece construction.

Similar to sleeve 12, the sleeve 62 includes a substantially-rectangular, relatively-large upper wall panel 72, a substantially-rectangular, relatively-large lower wall panel 74, an opposed pair of side edges 76 and 78, the open dispensing end 70, and the opposite end 80 which may or may not be closed and which may or may not be used for initially loading the blister cards, 64 and 66, into the sleeve 62.

The upper and lower wall panels 72 and 74 extend in substantially-parallel relation to the faces of the blister cards, 64 and 66. Thus, the upper and lower panels 72 and 74 are of a size that is slightly greater than the size of the blister cards, 64 and 66, or at least the area of the blister cards, 64 and 66, on which blister compartments 82 are located. The upper and lower wall panels 72 and 74 can be generally solid; however, as illustrated, they can include slot or other shaped openings 84 for aesthetic purposes and/or for purposes of reducing the amount of plastic required to make the sleeve 62. Although the openings 84 exist in the panels 72 and 74, their pattern, location and size are such that they prevent unwanted access and dispensing of the contained items from the blister compartments 82 and such that they do not greatly reduce the desired strength or rigidity of the package 60. The panels 72 and 74 can also include an optional window-type opening 86 for aesthetic purposes or for providing space for a label (not shown) or the like on the blister cards, 64 and 66, to be readable through one or both panels 72 and 74 when at least one of the blister cards, 64 and 66, is in the storage position.

The panels 72 and 74 can each include a small cut-out section 88 adjacent the open dispensing end 70 of the sleeve 62 for purposes of exposing the leading edges 68 of the blister cards, 64 and 66, thereby enabling ready gripping of either of the leading edges 68 when one of the blister cards, 64 and 66, is to be slid/pulled through the open dispensing end 70 of the package 60. These cut-out sections 88 can be offset to one another to enable easier selection between one of the two cards, 64 and 66.

Figure 15:
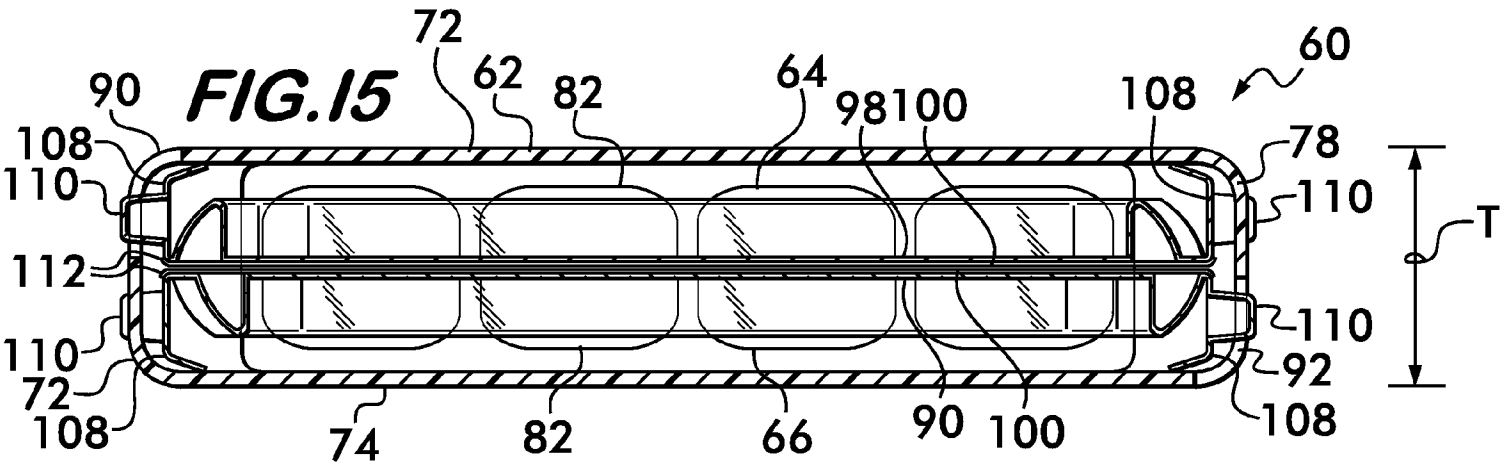
FIG. 15 is a cross-sectional view of the package assembly along line 15-15 of FIG. 13.
Figure 16:
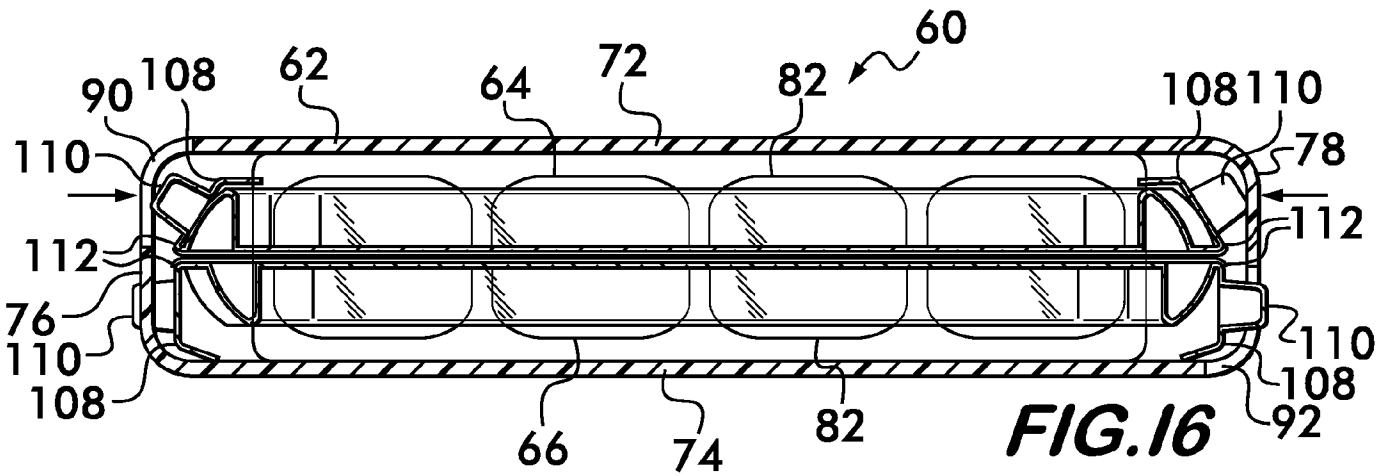
FIG. 16 is a cross-sectional view of the package similar to FIG. 15, except with the locking feature of the upper card disengaged to permit the upper blister card to slide relative to the protective sleeve.
Figure 17:
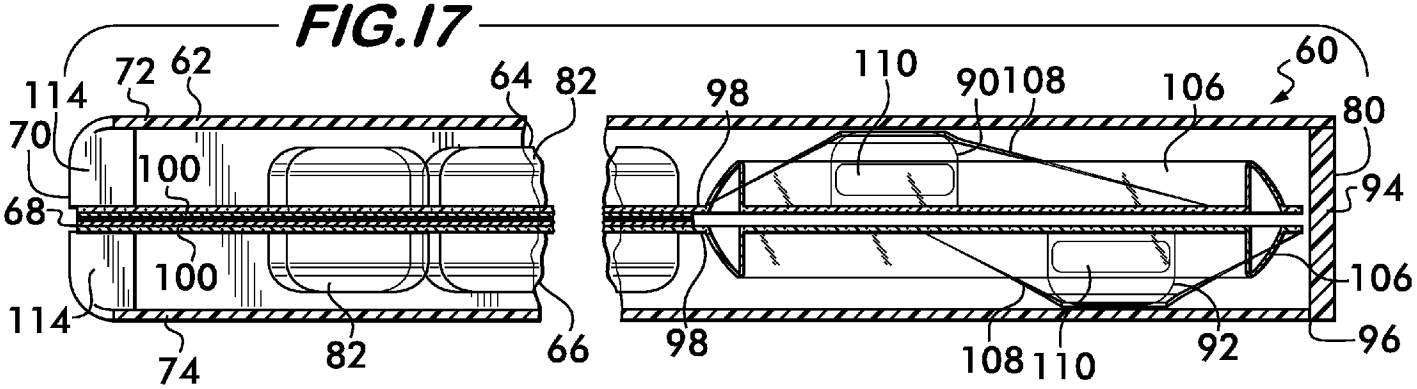
FIG. 17 is a cross-sectional view of the package assembly of FIG. 13 along the longitudinal axis of the assembly.
Figure 18:
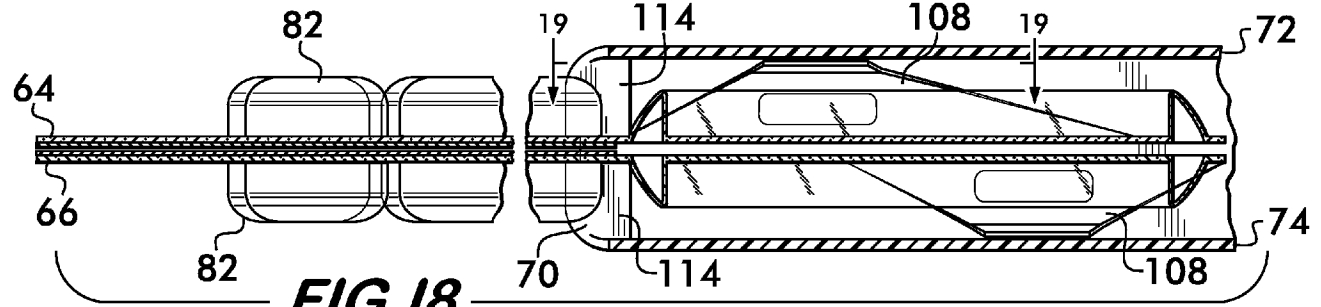
FIG. 18 is a cross-sectional view similar to FIG. 17 except both blister cards are shown in their dispensing positions adjacent the dispensing end of the protective sleeve.
Figure 19:
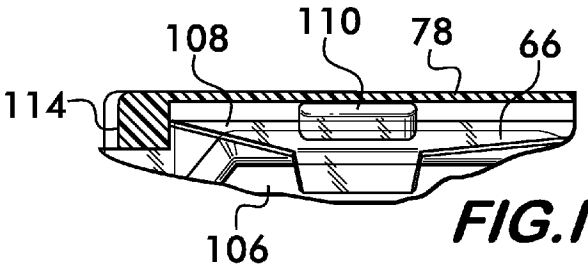
FIG. 19 is a cross-sectional view of the package assembly of FIG. 18 along line 19-19 of FIG. 18.

The side edges 76 and 78 of the sleeve 62 define the thickness "T" of the package 60 and therefore the spacing between wall panels 72 and 74. As an example, this spacing need only be slightly greater than twice the height of the blister compartments 82 as best shown in FIG. 15, assuming the blister compartments 82 are of a uniform height on each card, 64 and 66. Two sets of openings, flexible recesses, or the like, 90 and 92, are formed in the opposite side edges 76 and 78 of the sleeve 12. These sets of openings, 90 and 92, form part of the locking mechanism of the package 60 which independently secure each blister card, 64 and 66, in the storage position. Preferably, the sets of openings or recesses, 90 and 92, are located remote from the open dispensing end 70 of the package 60 adjacent the functionally closed end 80 of the package 60. Alternatively, the openings or recesses, 90 and 92, can be located anywhere along the side edges 76 and 78. In addition, the openings or recesses, 90 and 92, can be located directly across from one another, or they can be offset or staggered from one another along the side edges 76 and 78 as best illustrated in FIGS. 13 and 17.

The non-dispensing end 80 of the sleeve 62 can include an end wall 94. For instance, the end wall 94 can be secured in place (snapped, held by friction, bonded, glued, taped, etc.) to close the otherwise open end 80 of the sleeve 62 after the blister cards, 64 and 66, are initially loaded into the sleeve 62 through, for instance, the non-dispensing end 80. As best illustrated in FIG. 17, the end wall 94 can be formed integral with one of the wall panels 72 or 74 of the sleeve 62 via a live hinge 96 and can be bent or folded into position to close the end 80 of the sleeve 62, or alternatively, the end wall 94 can be separate of the sleeve 62 and be secured in place on the end 80 of the sleeve 62. Yet another alternative is to utilize tape, a post, a flange or the like to provide a stop adjacent the end 80 of the sleeve 62 merely for the purpose of preventing the blister cards, 64 and 66, from undesirably passing in a reverse direction through the non-dispensing end 80 of the sleeve 62.

Turning to the structure of the blister cards, 64 and 66, each can be essentially identical. This greatly simplifies assembly of the package 60 since any two blister cards can be selected for insertion into a one-piece sleeve 62. Alternatively, the blister cards, 64 and 66, can be different. In the illustrated embodiment, each blister card, 64 and 66, includes an elongate, generally-planar base strip of material 98 from which a plurality of laterally spaced-apart raised blister compartments 82 project. For example, the strip 98 can be made of thermoformable transparent plastic material and the blister compartments 82 can be provided as depressions/projections molded into a face thereof. Other configurations are also possible. A tablet or like small item can be placed in each hollow open ended compartment 82 and a foil backing or the like 100 can be secured (via adhesion or the like) to a rear face of the strip 98 to seal the tablets or like small items within the blister compartments 82.

The leading edge 68 of each blister card, 64 and 66, can include a grip tab 102 and an adjacent recess (not shown). Accordingly, when the blister cards, 64 and 66, are stacked together, back-to-back, the grip tab 102 of one blister card registers with the recess of the other blister card and vice versa. This makes it easier for the user to grip the leading edge 68 of one of the blister cards without gripping the leading edge 68 of the other of the blister cards.

Each of the blister cards, 64 and 66, includes a tail end section 106 opposite from its leading edge 68. The tail end section 68 can be formed as an integral continuation of the base strip 98, or alternatively, can be formed separate of the base strip 98 and simply be secured to one end thereof. The purpose of the tail end section 106 is to cooperate with the side edges 76 and 78 of the sleeve 62 to form the locking/release mechanism. The tail end section 106 can also be used to carry a label or other information which is viewable through the window-like opening 86 of the sleeve 62 discussed above.

The tail end section 106, as manufactured, includes a pair of lateral extensions or wings 108 in which tabs or like projections 110 are formed and/or attached. In the illustrated embodiment, the tabs 110 are formed as a thermoformed hollow projection or depression from the base strip material 98 and extend from the base strip material 98 in an opposite direction relative to the blister compartments 82. The tabs 110 function as latches of the locking mechanism of the package 60 and are cooperatively receivable in the openings or recesses, 90 or 92, in the side edges 76 and 78 of the sleeve 62. In the illustrated embodiment, the tabs 110 of each blister card are offset relative to one another. Thus, when identical cards, 64 and 66, are positioned back-to-back within the sleeve 62, the opposite tabs 110 of each blister card are offset in each side edge. Thus, the locations of the openings, 90 and 92, in each side edge, 76 and 78, can be offset thereby increasing the strength of the sleeve 62. Of course, other tab locations are possible, particularly if the blister cards are not required to be identical.

Each of the wings 108 interconnect to the tail end section 106 via a resilient live hinge 112 that enables the wings 108 to be resiliently bent, flexed, folded, or pivoted relative to the remainder of the tail end section 98. Thus, the wings 108 can be pivoted into a position that is generally perpendicular to the base strip material 98 to enable initial insertion of the blister cards, 64 and 66, into the sleeve 62. In this position, the tabs or latches 110 extend laterally of the blister cards, 64 and 66, in opposite directions such that they register with and extend within and/or through the openings, 90 and 92, in the side edges 76 and 78 of the sleeve 62.

The interconnection between each wing 108 and the remainder of the tail end section 106 is such that a resilient force is exerted on the tabs 110 in a direction into engagement with the openings or recesses, 90 and 92, of the side edges 76 and 78 of the sleeve 62. This force results in the wings 108 attempting to pivot about the live hinges 112 to return to a flattened, as manufactured, condition. Thus, when the tabs 110 register with the openings, 90 and 92, they resiliently pivot into the openings, 90 and 92, and become trapped or locked therein. Undesired dislodging of the tabs 110 from the openings, 90 and 92, is avoided due to this constant resilient force created by the interconnection of the wings 108 to the tail end section 106.

Accordingly, the separately-manufactured blister cards, 64 and 66, can be inserted separately or simultaneously into the sleeve 62 by sliding the leading edges 68 of the blister cards, 64 and 66, into the non-dispensing end 80 of the sleeve 62. The wings 108 of the tail end sections 106 of the blister cards, 64 and 66, are folded upward to permit the wings 108 to be received within the sleeve 62. The tabs or latches 110 engage the solid side edges, 76 and 78, of the sleeve 62 until they register with the openings, 90 and 92. When this occurs, the tabs 110 resiliently snap into the openings, 90 and 92, due to the resilient nature of the live hinges 112. Thereafter, the end wall 94 or the like can be secured in place across the end 80 of the sleeve 62 to provide a stop thereby preventing withdraw of either blister card, 64 and 66, through the end 80.

When a user desires to dispense a tablet or the like from one of the blister cards, 64 and 66, from the package 60, the user squeezes both tabs 110 in one of the sets of openings, 90 or 92, corresponding to one of the blister cards, 64 or 66, between a thumb and finger of one hand, to simultaneously position the tabs 110 inward within the sleeve 62. In this condition, the user can grip the appropriate leading front edge 68 of the blister card, 64 or 66, adjacent the open dispensing end 70 of the sleeve 62 and pull the blister card, 64 or 66, through the open dispensing end 70 via a sliding motion. As the selected blister card, 64 or 66, is slid through the sleeve 62, the tabs 110 of that blister card engage and slide along the solid sections of the side edges, 76 and 78. However, the sleeve 62 includes a pair of stops 114 adjacent the open dispensing end 70 of the sleeve 62 which engage the wings 108 and prevent the tail end section 106 from passing through the open dispensing end 70. The stops 114 can be provided as wall sections, flanges or posts that permit the sections of the blister cards, 64 and 66, having the blister compartments 82 to readily pass through the open dispensing end 70 of the sleeve 62, yet limit the tail end section 106 from passing therethrough. Accordingly, each blister card, 64 and 66, is effectively tethered to the sleeve 62 and cannot be completely separated therefrom during the useful life of the package 60 and each can be slid to a dispensing position independent of the other.

Various modifications to the packages 10 and 60 and their method of assembly can be made. For instance, the number, shape and configuration of the various panels and openings of the sleeves, 12 and 62, can be altered. The openings in the side edges can be replaced with flexible tabs or the like that have a recess for receiving the latch of the blister cards. Alternatively, these structures can be reversed so that the side edges include a latch and the wings include a recess or like opening. Further, the shape, size and/or pattern of the cutouts, ribs, and the like can be changed as well as the size, shape, number and positioning of the blister compartments. Also, instead of having a pair of locking tabs on each blister card, a single locking tab could be used.

While preferred packages and methods of assembly have been described in detail, various modifications, alterations, and changes may be made without departing from the spirit and scope of the package and method according to the present invention as defined in the appended claims.

The invention claimed is:

1. A package for storing tablets or like items and having child-resistant dispensing properties, comprising:

a card having a base strip on which a plurality of spaced-apart compartments are provided for holding the tablets or like items, said base strip having an opposed pair of side edges and a tail end, said tail end having an opposed pair of lateral extensions such that one of said lateral extensions extends laterally from one of said pair of side edges and another of said lateral extensions extends laterally from an opposite one of said pair of side edges, said lateral extensions being connected to said base strip via live hinges and said base strip being formed of a sheet of plastic with said lateral extensions and live hinges being formed integral with said base strip; and a separate hollow sleeve having an opposed pair of side edges extending between opposite ends of said sleeve with at least one of said ends being a dispensing end, said sleeve providing a protective housing for said card when said card is in a storage position within said sleeve, and said card being slidable relative to said sleeve between said storage position and a dispensing position in which said card extends at least partially outside said sleeve to expose at least one of said compartments;

said card having a locking tab formed on each of said lateral extensions;

said live hinges of said lateral extensions extending parallel to each other and enabling said lateral extensions to pivot relative to said base strip about said live hinges; and said side edges of said sleeve having openings cooperating and registering with said locking tabs of said card to automatically lock said card in said storage position when said card is slid within said sleeve to said storage position with said lateral extensions pivoted upwardly relative to said card about said live hinges such that said lateral extensions extend generally perpendicular to said base strip.

2. A package according to claim 1, wherein said lateral extensions are resiliently connected to said card via said live hinges such that said locking tabs are resiliently urged into said openings in said side edges of said sleeve when said locking tabs register with said openings or recesses, and wherein the connection of said lateral extensions to said card via said live hinges is flexible such that simultaneous squeezing of said locking tabs toward one another and inward of said sleeve unlocks said card from said sleeve permitting said card to slide relative to said sleeve.

3. A package according to claim 2, wherein said hollow sleeve is a one-piece, molded, elongate, plastic sleeve having opposite wall panels interconnected and spaced-apart by said opposite pair of elongate side edges.

4. A package according to claim 3, wherein said side edges and said pair of opposed openings are spaced apart by at least 1 inch.

5. A package according to claim 4, wherein said sleeve includes at least one integrally molded stop adjacent said dispensing end for preventing complete separation of said card from said sleeve when said card is in said dispensing position extending from said dispensing end of said sleeve.

6. A package according to claim 5, wherein said sleeve includes an end wall for said opposite end that is integrally formed with one of said wall panels via a live hinge.

7. A package according to claim 1, wherein said package includes at least two separate cards each having an opposed pair of locking tabs, wherein said side edges of said sleeve include at least one opening for each locking tab of said at least two separate cards such that said at least two separate cards can be locked within said sleeve independently of the other one of said at least two separate cards, and wherein said single sleeve is of a size to simultaneously slidably receive said at least two separate cards in a stacked condition and provide a protective housing for said at least two cards.

8. A package for storing tablets or like items having child-resistant, senior-friendly dispensing properties, comprising:

a blister card having a base strip on which a plurality of upstanding blister compartments are provided in which the tablets or like items are held, said blister card having a leading front edge and an opposite tail end section, said tail end section being formed with a pair of wings extending laterally from opposite side edges of said tail end section, each of said wings interconnecting with said tail end section via a hinge about which said wings pivot, said hinges extending parallel to one another, and each of said wings having a locking tab extending outwardly therefrom; and a hollow one-piece, molded, elongate, plastic sleeve having an opposed pair of elongate side edges, at least one dispensing end, and opposite wall panels interconnected and spaced-apart by said opposite of donate side edges, said sleeve providing a protective housing for said blister card when said blister card is in a storage position within said sleeve, and said blister card being slidable relative to said sleeve between said storage position and a dispensing position in which said blister card extends at least partially outside said sleeve to expose at least one of said blister compartments;

each of said side edges of said sleeve having an opening for cooperating and registering with one of said locking tabs of said blister card so that said blister card is automatically locked in said storage position when said blister card is slid within said sleeve to said storage position; and said wings pivoting about said hinges in a resilient manner such that said wings extend generally perpendicular to said blister card whereby said locking tabs snap into said openings in said side edges of said sleeve when said locking tabs register with said openings, and said locking tabs and wings flexibly pivoting about said hinges such that simultaneous squeezing of said locking tabs inward of said sleeve unlocks said blister card from said storage position such that said blister card is slidable relative to said sleeve.

9. A package according to claim 8, wherein said base strip is a sheet of thermoformable plastic material, and wherein said blister compartments, wings, hinges, and locking tabs are formed by integral parts of said base strip.

10. A package according to claim 9, wherein said base strip has a substantially rectangular perimeter, wherein said wings extend laterally from opposite sides edges of said perimeter, and wherein said wings are pivoted about said hinges for insertion within said sleeve.

11. A package according to claim 10, wherein said side edges and said pair of opposed openings are spaced apart by at least 1 inch.

12. A package according to claim 11, wherein said sleeve includes at least one integrally molded stop adjacent said dispensing end for preventing complete separation of said blister card from said sleeve in said dispensing position, and wherein said sleeve includes an end wall for an opposite end of said sleeve such that said end wall is integrally formed with one of said wall panels via a live hinge.

13. A package according to claim 8, wherein said package includes separate first and second ones of said blister card stacked back-to-back and simultaneously slidably receivable within said sleeve, and wherein said side edges of said sleeve includes at least two sets of openings so that each blister card is independently lockable and slidably relative to said sleeve.

14. A method of forming and assembling a package having child-resistant, senior-friendly dispensing properties, comprising the steps of:

forming a blister card with blister compartments and a pair of wings extending laterally of the blister card from opposite sides of the blister card, and providing a locking tab on each wing;

folding or pivoting each of the wings about a resilient hinge interconnecting the wing to the blister card such that the wings extend generally perpendicular to the blister card, each of the hinges extending parallel to each other; and sliding the blister card into a protective sleeve while the wings remain folded until the locking tabs on the wings register and cooperatively resiliently snap into openings formed in side edges of the sleeve to lock the blister card in a storage position within the sleeve.

15. A method according to claim 14, further comprising the step of molding the sleeve of plastic such that said sleeve is a one piece molded hollow body having an open dispensing end and an opposite end.

16. A method according to claim 15, wherein said blister card is inserted into said opposite end during said sliding step and further comprising the step of closing the opposite end with an end wall after said sliding step.

* * * * *